United States Patent [19]

Torizuka

[11] Patent Number: 4,494,513

[45] Date of Patent: Jan. 22, 1985

[54] FUEL INJECTION PUMP FOR INTERNAL COMBUSTION ENGINES, FREE FROM EROSION OF THE PUMP HOUSING

[75] Inventor: Keizi Torizuka, Higashimatsuyama, Japan

[73] Assignee: Diesel Kiki Co., Ltd., Tokyo, Japan

[21] Appl. No.: 510,875

[22] Filed: Jul. 5, 1983

[30] Foreign Application Priority Data

Jul. 14, 1982 [JP] Japan ..... 57-106640[U]

[51] Int. Cl.[3] ..... F02M 59/44

[52] U.S. Cl. ..... 123/495; 417/499

[58] Field of Search ..... 123/495, 446; 417/499, 417/490, 533

[56] References Cited

U.S. PATENT DOCUMENTS

| | | | |
|---|---|---|---|
| 2,185,144 | 12/1939 | Edwards | 417/494 |
| 2,975,776 | 3/1961 | Nicolls | 123/495 |
| 4,222,717 | 9/1980 | Clouse et al. | 417/499 |

FOREIGN PATENT DOCUMENTS

| | | | |
|---|---|---|---|
| 295244 | 12/1971 | Austria . | |
| 74650 | 3/1983 | European Pat. Off. | 123/495 |
| 1941827 | 3/1970 | Fed. Rep. of Germany . | |
| 2547071 | 5/1977 | Fed. Rep. of Germany | 123/495 |
| 59054 | 4/1982 | Japan | 123/495 |
| 2042066 | 9/1980 | United Kingdom | 123/495 |
| 750120 | 7/1980 | U.S.S.R. | 123/495 |

*Primary Examiner*—Magdalen Y. C. Moy

*Attorney, Agent, or Firm*—Frishauf, Holtz, Goodman & Woodward

[57] ABSTRACT

The pump housing has at least one pump accommodating space formed therein, in which a pump element and an element holder are fitted. The element holder has a sleeve portion axially extending at least as far as a location facing a feed hole formed in the plunger barrel of the pump element, and defining a fuel chamber between itself and the plunger barrel, in which the feed hole opens. The sleeve portion of the element holder has at least one fuel supply hole formed therein and opening in the fuel chamber at a location which is different from that of the feed hole in at least one of the axial and circumferential directions of the sleeve portion and the plunger barrel. Immediately upon completion of each delivery stroke of the plunger, pressurized fuel flowing back from the delivery chamber in the plunger barrel into the fuel chamber through the feed hole collides with the inner peripheral surface of the sleeve portion of the element holder, thereby preventing erosion of the pump housing.

9 Claims, 3 Drawing Figures

FUEL INJECTION PUMP FOR INTERNAL COMBUSTION ENGINES, FREE FROM EROSION OF THE PUMP HOUSING

BACKGROUND OF THE INVENTION

This invention relates to fuel injection pumps for internal combustion pumps, and more particularly to a fuel injection pump of this kind, which is free from erosion of the pump housing and therefore has a prolonged effective life.

An in-line type fuel injection for use with Diesel engines has a pump housing formed therein with a plurality of pump accommodating spaces arranged in a line, each of which accommodates a pump element comprised of a plunger barrel and a plunger for reciprocating motion in the plunger barrel. The pump element is supported by an element holder in a manner hung therefrom, which also supports a delivery valve holder holding a delivery valve within the element holder. An annular fuel chamber is defined between the pump accommodating space of the pump housing and the plunger barrel, which communicates, on one hand, with a fuel intake hole formed in the pump housing, and on the other hand, with a delivery chamber defined between the plunger and the plunger barrel, through a feed hole formed in the plunger barrel, respectively. With this arrangement, as the plunger makes a reciprocating motion in the plunger barrel, fuel is sucked into the delivery chamber through the fuel intake hole, the fuel chamber and the feed hole, and pressurized therein and delivered through the delivery valve to be injected into an associated engine. Immediately upon completion of each delivery stroke of the plunger, pressurized fuel flows back from the delivery chamber into the fuel chamber through the feed hole, colliding with a portion of the inner peripheral surface of the pump housing facing the feed hole. As a consequence, the same portion of the inner peripheral surface becomes eroded by the pressurized fuel. The degree of erosion is high particulary in a pump housing made of a material having low hardness such as aluminum.

In order to avoid such erosion, in a conventional in-line type fuel injection pump, an annular deflector is fitted around the plunger barrel and disposed within the fuel chamber at a location opposite the feed hole. Such deflector is formed with a suitable number of through holes for passing fuel therethrough, and fitted with low rigidity around the plunger barrel for facilitation of the mounting of same. Therefore, after the lapse of some time of use, the deflector becomes dislocated in circumferential position so that one of the above through holes formed therein and the feed hole become circumferentially and axially aligned with each other. Consequently, upon completion of each delivery stroke of the plunger, fuel ejected through the feed hole strikes directly against the inner peripheral surface of the pump housing, causing erosion of same. Thus, erosion of the pump housing cannot be positively prevented even with such deflector.

Further, the pump housing of the conventional fuel injection pump is also formed therein with a space for receiving a fuel control rod for adjusting the effective delivery stroke of the plunger, as well as with a fuel chamber. Therefore, the pump housing has rather a complicate configuration, resulting in a high manufacturing cost of the pump.

BACKGROUND OF THE INVENTION

It is an object of the invention to provide a fuel injection pump for internal combustion engines, which is free from erosion of the pump housing caused by pressurized fuel flowing back from the delivery chamber in the plunger barrel immediately after termination of each delivery stroke of the plunger.

It is a further object of the invention to provide a fuel injection pump for internal combustion engines, which facilitates machining of the pump housing, thereby being low in manufacturing cost, and also can be compact in size.

According to the invention, a pump housing has at least one pump accommodating space formed therein. An element holder holds a pump element including a plunger barrel and a plunger in place within the above pump accommodating space. The element holder includes a sleeve portion having a substantially hollow cylindrical configuration, which is fitted in the pump accommodating space of the pump housing and axially extends at least as far as a location facing a feed hole formed in the plunger barrel. The sleeve portion has its peripheral wall formed with at least one fuel supply hole. The sleeve portion and the plunger barrel of the pump element cooperate to define an annular fuel chamber therebetween, in which the above feed hole opens. The above fuel supply hole in the sleeve portion and the feed hole in the plunger barrel open in the above fuel chamber at locations different from each other in at least one of directions axial and circumferential of the sleeve portion and the plunger barrel.

Further, the sleeve portion of the element holder has its peripheral wall formed with a notched portion receiving a control rod engaging with the plunger for causing circumferential displacement of same. Also, the sleeve portion cooperates with the pump accommodating space of the pump housing and a tappet interposed between the plunger and cam means for driving the plunger, to define therebetween a chamber in which a plunger return spring is received.

The above and other objects, features and advantages of the invention will be more apparent from the ensuing detailed description taken in conjunction with the accompanying drawings.

DETAILED DESCRIPTION

Figure 1:
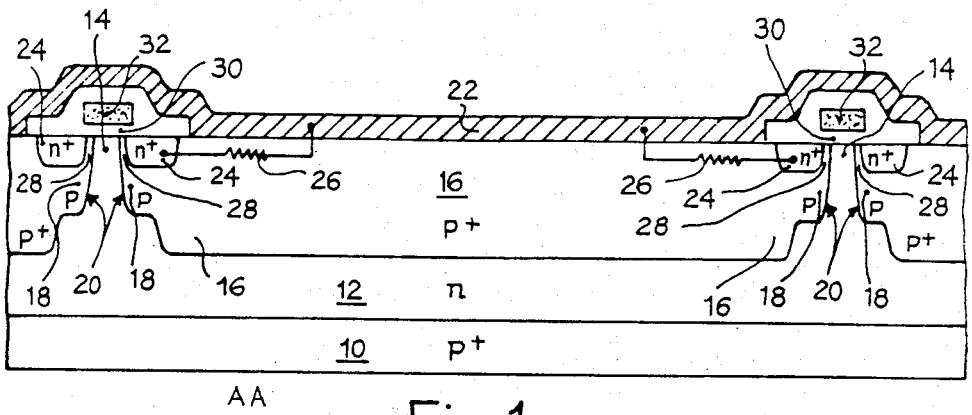
FIG. 1 is a longitudinal sectional view illustrating a typical example of a conventional in-line type fuel injection pump adapted for use with Diesel engines.

Referring first to FIG. 1, there is shown a conventional typical in-line type fuel injection pump. A pump housing 1 is formed therein with a pump accommodating space 1*a* in which is fitted a pump element 2 formed by a plunger barrel 2*a* and a plunger 2*b*. The pump element 2 is held in place within the pump housing 1 by means of an element holder 4 which also holds a delivery valve holder 3*b* retaining a delivery valve 3*a* in contact with an upper surface of the pump element 2. The element holder 4 has a flanged portion 4*a* and a sleeve portion 4*b* integrally formed in one piece, the flanged portion 4a being fastened to the pump housing 1 by means of bolts 5. The pump accommodating space 1a has an enlarged portion at a predetermined axial location, which defines an annular fuel chamber 7 in cooperation with the opposed plunger barrel 2a, in which opens a feed hole 6 formed through the peripheral wall of the plunger barrel 2a. An annular deflector 8 is fitted around the plunger barrel 2a and disposed within the fuel chamber 7 in a manner facing the feed hole 6. The deflector 8 is intended to serve to prevent pressurized fuel flowing back from a delivery chamber 2a' defined in the plunger barrel 2a through the feed hole 6 from colliding with the inner peripheral surface of the pump housing 1, thereby preventing erosion of the same inner peripheral surface. The degree of erosion is particularly high if the pump housing 1 is formed of a material having low hardness such as aluminum. A lower end of the plunger barrel 2b remote from the delivery valve 3a is disposed in engagement with a tappet 11 via a lower spring seat 10a on which is seated one end of a plunger return spring 9. The tappet 11 is disposed in contact with a camming surface 14 formed on a camshaft 13 disposed for rotation in unison with a crankshaft, not shown, of an associated engine. Rotation of the camshaft 13 causes reciprocation of the plunger 2b within the plunger barrel 2a for sucking and pressure delivery of fuel. A control sleeve 15 is inserted into the plunger return spring 9, on an upper end of which is fitted an upper spring seat 10b which is urged by the other end of the plunger return spring 9. Formed in the inner peripheral surface of the pump housing 1 is a recess 1b through which extends a control rod 16 having an L-shaped cross section. Displacement of the control rod 16 along its axis causes rotation of the control sleeve 15 through a ball 17 engaging with the control rod 16, which in turn causes a change in the circumferential position of the plunger 2b engaging with the control sleeve 15. Consequently, the time of communication between a lead 18 formed in the plunger 2b and the feed hole 6 during the delivery stroke of the plunger 2b is varied to vary the effective delivery stroke of the plunger 2b, thus controlling the fuel injection quantity.

The deflector 8 is fitted with low rigidity on the plunger barrel 2a so as to facilitate mounting of the former onto the latter. Therefore, the deflector 8 can be circumferentially dislocated relative to the plunger barrel 2a so that the feed hole 6 of the plunger barrel 2a becomes aligned with one of through holes, not shown, formed in the peripheral wall of the deflector 8 for passing fuel therethrough. As a consequence, a backflow of fuel into the fuel chamber 7 through the feed hole 6 directly collides with the inner peripheral wall surface of the pump housing 1, causing erosion of the same peripheral wall surface.

Figure 2:
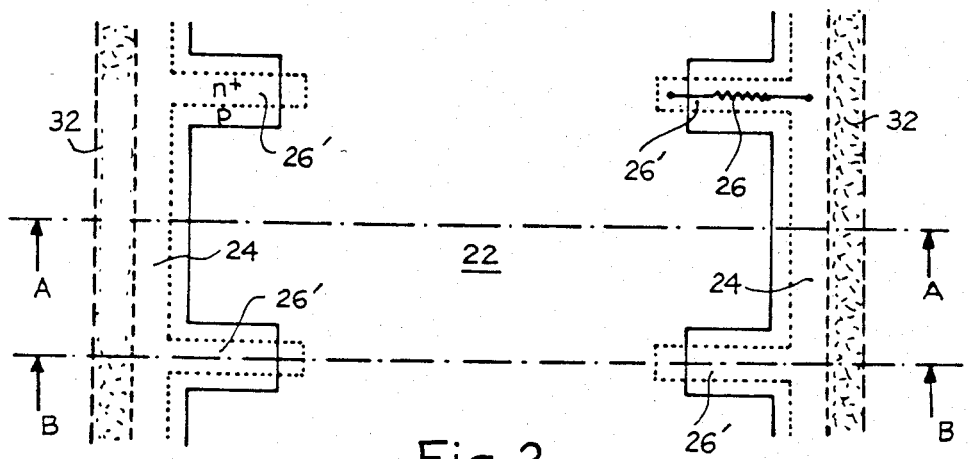
FIG. 2 is a fragmentary sectional view illustrating an in-line type fuel injection pump according to an embodiment of the invention.
Figure 3:
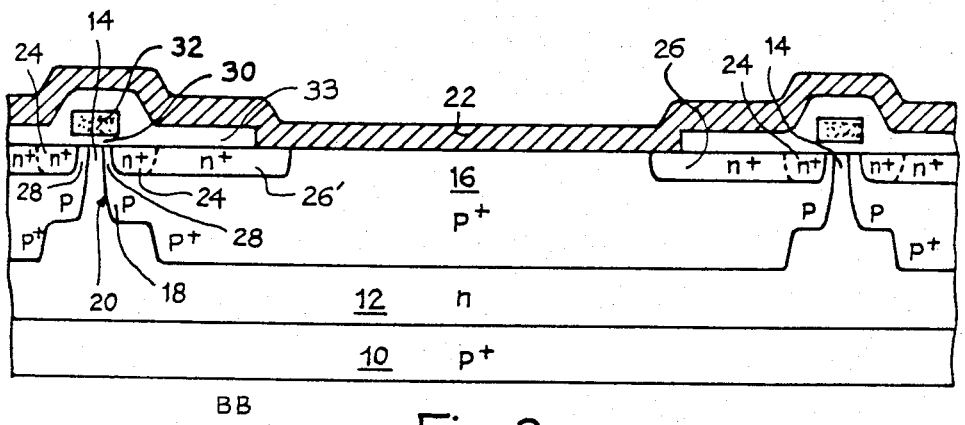
FIG. 3 is a sectional view taken along line III—III in FIG. 2.
Figure 4:
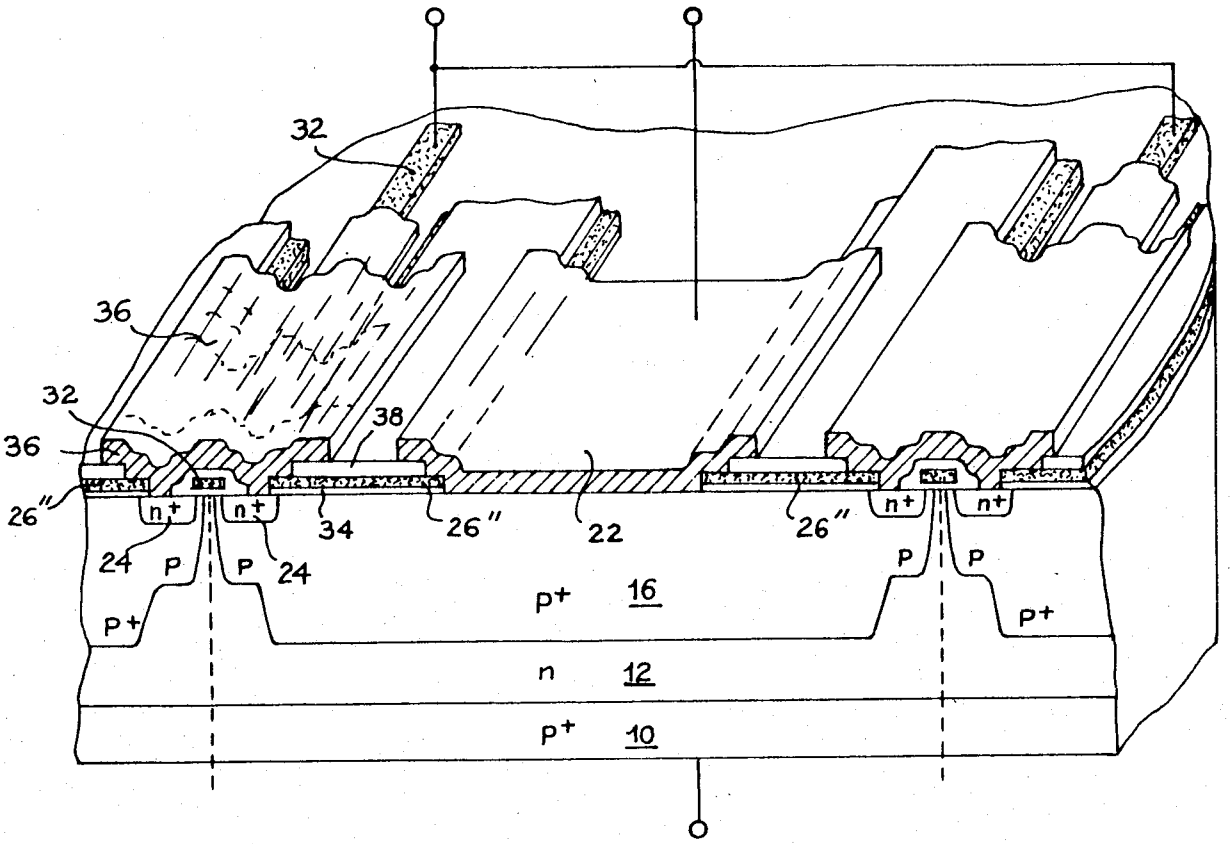

A fuel injection pump according to the invention will now be described in detail with reference to FIGS. 2 and 3 showing an embodiment of the invention.

Reference numeral 20 designates a pump housing which is formed of an aluminum die casting for reduction of the weight of the whole pump and is formed therein with a plurality of through holes 21, only one of which is shown, each having a cylindrical inner peripheral wall with an annular stepped shoulder and forming a pump accommodating space. These through holes or pump accommodating spaces 21 are arranged in a line at suitable intervals. Fitted in each of the pump accommodating spaces 21 is an element holder 30 which comprises a flanged portion 31 and a sleeve portion 32 which is formed of a material having high hardness, i.e. higher than that of a material forming the pump housing, preferably steel, for instance a steel bar S48C according to JIS G3102, and has a hollow cylindrical configuration. Two O-rings 40, 41 are interposed between the sleeve portion 32 which is fitted in the pump accommodating space 21 and the pump accommodating space 21 to seal off the gap therebetween in a liquidtight manner. The flanged portion 31 of the element holder 30 is fixed to an upper surface 20a of the pump housing 20 by means of bolts 42 extending through respective elongate holes 31a formed through the flanged portion 31 and threadedly fitted in respective tapped holes 20b formed in the pump housing 20, to hold the sleeve portion 32 in place within the pump housing 20. The elongate holes 31a are arcuate in shape, circumferentially extending in concentricity with the sleeve portion 32 for permitting adjustment of the circumferential position of the element holder 30.

The sleeve portion 32 of the element holder 30 has its inner peripheral surface formed with the aforementioned annular stepped shoulder 32a at a lower location, and is also formed with a notched portion 32b at a lower end portion, through which a control rod 43 extends. Further, a lower end surface of the sleeve portion 32 cooperates with the through hole 21 of the pump housing 20 and a tappet 80, hereinafter referred to, to define therebetween a chamber 59 in which a plunger return spring 54 is accommodated. Formed through the sleeve portion 32 is an axial through bore 32c in which is fitted a pump element 50 composed of a plunger barrel 51 and a plunger 52 slidably disposed within the plunger barrel 51. An annular gasket 44 is interposed between an annular stepped shoulder 51b formed in the outer peripheral surface of the plunger barrel 51 and the annular stepped shoulder 32a of the sleeve portion 32, to seal off the gap between the plunger barrel 51 and the sleeve portion 32 in a liquidtight manner. The plunger barrel 51 is held in a predetermined circumferential position by a dowel pin 46 fitted in a hole 32f formed in a lower portion of the sleeve portion 32 and a longitudinal groove 51d formed in the plunger barrel 51. The axial through bore 32c of the sleeve portion 32 of the element holder 30 has a larger diameter along a portion axially extending upwardly from the annular stepped shoulder 32a, and the inner peripheral surface 32c' of the same enlarged portion cooperates with the opposed outer peripheral surface 51c of the plunger barrel 51 to define an annular fuel chamber 60 therebetween.

A feed hole 51a is formed through the peripheral wall of a head portion of the plunger barrel 51, which opens in the above fuel chamber 60 on one hand, and opens in a delivery chamber 53 defined between the plunger 52 and the plunger barrel 51, on the other hand. A fuel intake hole 22 is formed in the pump housing 20, which obliquely extends from a side wall surface 20c of the housing 20 and opens at an inner end 22a in an annular space 23 defined between the inner peripheral surface 21a of the enlarged portion of the through hole 21 and the outer peripheral surface 32e of the sleeve portion 32. A fuel supply hole 32d is formed through the peripheral wall of the sleeve portion 32 and opens in the above annular space 23, on one hand, and opens in the above fuel chamber 60, on the other hand. Thus, the feed hole 51a of the plunger barrel 51 communicates with the fuel intake hole 22 via the fuel chamber 60, the fuel supply hole 32d and the annular space 23.

As shown in FIG. 3, in the illustrated embodiment, the feed hole 51*a* and the fuel supply hole 32*d* are circumferentially offset through an angle of 90 degrees. Further, as shown in FIG. 2, the both holes 51*a*, 32*d* are slightly axially offset, that is, the feed hole 51*a* is located at a slightly lower level than the fuel supply hole 32*d* or biased toward the plunger 52. In this way, the two holes 51*a*, 32*d* are different in both of the directions circumferential and axial of the plunger 52 and the sleeve portion 32, so that immediately upon completion of each delivery stroke of the plunger 52, a jet of pressurized fuel flowing back from the delivery chamber 53 in the plunger barrel 51 through the feed hole 51*a* strikes against the inner peripheral wall 32*c*' of the sleeve portion 32 formed of a hard material. By virtue of this arrangement, erosion of the inner peripheral wall of the pump housing 20 per se can be prevented, which would otherwise be directly shot at by the jet of pressurized fuel.

A delivery valve 71 is disposed within the axial through bore 32*c* of the sleeve portion 32, in contact with the upper surface of the plunger barrel 51, and a delivery valve holder 70 is threadedly fitted in a tapped upper end portion of the bore 32*c* to hold the delivery valve 71 in place. The delivery valve holder 70 accommodates a valve spring 72 interposed taut between the bottom of same and the valve body of the delivery valve 71. An O-ring 45 is interposed between the bore 32*c* and the delivery valve holder 73 to seal off the gap therebetween in a liquid-tight manner.

The plunger 52 has its lower end disposed in contact with the aforementioned tappet 80 via a lower spring seat 55 supporting a plunger return spring 54 accommodated within the plunger return spring chamber 59. The tappet 80 is disposed in contact with a roller 81 which is in engagement with a camming surface formed on a camshaft, not shown, disposed for rotation in unison with a crankshaft, not shown, of an associated engine, in the same manner as in the fuel injection pump of FIG. 1. Rotation of the camshaft causes reciprocation of the plunger 52 in the plunger barrel 51 for sucking, pressurizing and delivery of fuel. The upper end of the plunger return spring 54 is disposed in urging contact with an upper spring seat 56 held against the bottom surface of the sleeve portion 32 of the element holder 30. Fitted in the plunger return spring 54 is a control sleeve 57 which is fitted over a driving face 52*a* formed on a lower portion of the plunger 52, for rotation in unison therewith. The control sleeve 57 has an upper flanged portion 57*a* engaging with the control rod 43 via a ball 58 secured on the control sleeve 57 and slidably fitted in a groove 43*a* formed in the control rod 43. The flanged portion 57*a* is rotatably fitted through a recess 32*g* formed in a lower end face of the sleeve portion 32. The control rod 43 has its main body 43*b* fitted through an opening 20*d* formed in the peripheral wall of the housing 20 in axial alignment with the notched portion 32*b* in the sleeve portion 32 for horizontal sliding movement therein, and is prevented from disengagement from the opening 20*d* by means of a retainer 61 which is secured to the peripheral wall of the housing 20, for example, by rivets 61*a*. As the control rod 43 is moved axially of the camshaft, the plunger 52 is rotated or circumferentially displaced via the control sleeve 57. A lead 52*b* is formed in the outer peripheral surface of a head of the plunger 52, for controlling the effective delivery stroke of the plunger 52 or the fuel injection quantity, in cooperation with the feed hole 51*a*.

The fuel injection pump according to the invention constructed as above is assembled in the following manner: The sleeve portion 32 of the element holder 30 with the O-rings 40, 41 fitted thereon beforehand is inserted into the through hole 21 of the pump housing 20, and then the plunger barrel 51 of the pump element 50 is inserted into the axial through bore 32*c* of the element holder 30 until the stepped shoulder 51*b* of the plunger barrel 51 is brought into contact with the stepped shoulder 32*a* of the sleeve portion 32 via the gasket 44 fitted on the plunger barrel 51 beforehand, and then located in a predetermined circumferential position relative to the element holder 30 by means of the dowel pin 46. Then, the valve seat of the delivery valve 71 is positioned onto the plunger barrel 51 thus fitted in the sleeve portion 32, and then the delivery valve spring 72 and the valve body of the delivery valve 71 is positioned into the interior of the delivery valve holder 70, followed by screwing the delivery valve holder 70 with the O-ring 45 fitted thereon beforehand, into the upper tapped portion of the axial through bore 32*c* of the sleeve portion 32, thus setting the pump element 50 as well as the delivery valve 71 in place within the bore 32*c* of the sleeve portion 32. Thereafter, the flanged portion 31 of the element holder 30, which is fabricated separately from the sleeve portion 32 in the illustrated embodiment, is fitted on the upper end of the sleeve portion 32 and fastened to the upper surface 20*a* of the pump housing 20 by screwing bolts 42 into the tapped holes 20*b* through the elongate holes 32*a* of the flanged portion 31. After this, the control sleeve 57, the upper spring seat 56, the plunger spring 54 and the lower spring seat 55 are successively mounted into the through hole 21 of the pump housing 20 through the lower end of the hole 21, followed by inserting the plunger 52 into the plunger barrel 51 through its lower end, and mounting the tappet and roller assembly 80, 81 in place. Finally, the control rod 43 is inserted through the notched portion 32*b* in the lower part of the sleeve portion 32, thus completing the assemblage.

Adjustment of the timing of fuel injection beginning after the assemblage of the fuel injection pump is adjusted by varying the thickness of a shim 33 interposed between the flanged portion 31 of the element holder 30 and the upper surface 20*a* of the pump housing 20. The fuel injection quantity is adjusted by loosening the bolts 42 and then rotating the element holder 30 through a suitable angle so as to rotate the plunger barrel 51 fixed in circumferential position relative to the element holder 30, relative to the plunger 52, thereby varying the position of the lead 52*b* in the plunger 52 with respect to the feed hole 51*a*.

The fuel injection pump according to the invention constructed as above provides excellent results as follows:

(i) Since a jet of pressurized fuel flowing back through the feed hole 51*a* is received by the inner peripheral wall of the sleeve portion 32 of the element holder 30, formed of a hard material, immediately upon completion of each delivery stroke of the plunger, erosion of the inner peripheral wall of the pump housing 20 can be prevented, which conventionally undergoes direct collision with a backflow of pressurized fuel;

(ii) Omission of the deflector 8 conventionally disposed between the pump housing and the feed hole makes it possible to reduce the volume of the space accommodating the pump element 50, thereby permitting designing the whole pump compact in size;

(iii) While the sleeve portion 32 of the element holder 30 is formed with an enlarged portion 32c' defining the fuel chamber 60 and a notch 32b for receiving the control rod 43, the pump housing 20 per se need not be formed with either of a space defining the fuel chamber and a space for receiving the control rod. This permits designing a portion of the pump housing formed with each pump accommodating space simple in shape, such as in a hollow cylinder having plain outer and inner surfaces, thereby facilitating the machining operation, resulting in a reduction in the manufacturing cost.

While the invention has been particularly shown and described with reference to a preferred embodiment thereof, it will be understood by those skilled in the art that the foregoing and other changes in form and details can be made therein without departing from the spirit and scope of the invention.

What is claimed is:

1. In a fuel injection pump having: a pump housing (20) having at least one pump accommodating space (21) formed therein; a pump element (50) mounted in said pump accommodating space (21) of said pump housing (20), said pump element (50) including a plunger barrel (51) having a peripheral wall thereof formed with a feed hole **(51*a*) and an outer peripheral surface thereof formed with an annular stepped shoulder (51*b*), and a plunger (52) slidably fitted in said plunger barrel (51), said plunger barrel (51) and said plunger (52) cooperating to define a delivery chamber (53) therebetween in which said feed hole (51*a*) opens; an element holder (30) holding said pump element (50) in place within said pump accommodating space (21) of said pump housing (20), said element holder (30) including a sleeve portion (32) having a substantially hollow cylindrical configuration, said sleeve portion (32) being fitted in said pump accommodating space (21) of said pump housing (20) and axially extending, said sleeve portion (32) having an inner peripheral surface thereof formed with an annular stepped shoulder (32*a*) fitted in said annular stepped shoulder (51*b*) of said plunger barrel (51), and a peripheral wall thereof formed with at least one fuel supply hole (32*d*), said sleeve portion (32) of said element holder (30) and said plunger barrel (51) of said pump element (50) cooperating to define an annular fuel chamber (60) therebetween, said fuel supply hole (32*d*) in said sleeve portion (32) and said feed hole (51*a*) in said plunger barrel (51) opening in said fuel chamber (60) at locations different from each other in at least one of directions axial and circumferential of said sleeve portion (32) and said plunger barrel (51); a control sleeve (57) disposed for rotation in unison with said plunger (52); a tappet (80) disposed in contact with said plunger (52); a plunger return spring (54) for biasing said tappet (80) in a direction away from said plunger (52); and a spring seat (56) on which said plunger return spring (54)** seats;

the improvement wherein:

said sleeve portion (32) of said element holder (30) is formed of a material having a hardness higher than that of a material forming said pump housing (20), and has a peripheral wall thereof formed with a notched portion **(32*b*)** and one end surface thereof formed with a recessed portion;

said spring seat (56) has an annular shape and receives said control sleeve (57) fitted therethrough and is disposed in contact with said one end surface of said sleeve portion (32) of said element holder (30); and a control rod (43) engages with said control sleeve (57) for causing circumferential displacement thereof and has a radially inwardly projected portion **(43*a*) inserted into said notched portion (32*b*) of said sleeve portion (32) of said element holder (30) and engages with said control sleeve (57) through a ball (58) mounted on the said control sleeve (57)**.

2. A fuel injection pump as claimed in claim 1, wherein said sleeve portion (32) of said element holder (30) cooperates with said pump accommodating space (21) of said pump housing (20) and said tappet (80) to define therebetween a plunger return spring chamber (50) which accommodates said plunger return spring (54).

3. A fuel injection pump as claimed in claim 1, wherein said pump housing (20) is formed of an aluminum die casing, and said sleeve portion (32) of said element holder (30) is formed of a material having a hardness higher than that of aluminum forming said pump housing (20).

4. A fuel injection pump as claimed in claim 1, including a retainer (61) secured to a peripheral wall of said housing (20), said peripheral wall of said housing (20) having an opening **(20*d*) formed therein in axial alignment with said notched portion (32*b*) of said sleeve portion (32), said control rod (43) having a main body portion (43*b*) fitted through said opening (20*d*) for horizontal sliding motion therein and prevented from disengagement from said opening (20*d*) by means of said retainer (61)**.

5. A fuel injection pump as claimed in claim 1, including a delivery valve, and a delivery valve holder holding said delivery valve adjacent said plunger barrel, said delivery valve and said delivery valve holder being mounted in said sleeve portion of said element holder.

6. A fuel injection pump as claimed in claim 5, wherein said delivery valve holder is threadedly fitted in said sleeve portion of said element holder.

7. A fuel injection pump as claimed in claim 1, wherein said pump housing has a surface, said pump including a flange member forming part of said element holder, and means fixing said flange member to said surface of said pump housing, said sleeve portion of said element holder being held in place within said pump accommodating space of said pump housing by said flange member.

8. A fuel injection pump as claimed in claim 1, including at least one sealing member interposed between said pump accommodating space of said pump housing and said sleeve portion of said element holder.

9. A fuel injection pump as claimed in claim 1, including a sealing member interposed between said annular stepped shoulder of said sleeve portion of said element holder and said annular stepped shoulder of said plunger barrel of said pump element.

* * * * *